US005933512A

United States Patent [19]

Tamura

[11] Patent Number: 5,933,512

[45] Date of Patent: Aug. 3, 1999

[54] DOUBLE CONE-TYPE LOUDSPEAKER

[75] Inventor: Kazuaki Tamura, Osaka, Japan

[73] Assignee: Matsushita Electric Industrial Co., Ltd., Osaka, Japan

[21] Appl. No.: 08/870,310

[22] Filed: Jun. 6, 1997

[30] Foreign Application Priority Data

Jun. 6, 1996 [JP] Japan ..... 8-144028

[51] Int. Cl.[6] ..... H04R 25/00

[52] U.S. Cl. ..... 381/424; 381/186; 381/427; 381/432

[58] Field of Search ..... 381/182, 186, 381/424, 423, 429, 432; 181/163, 164, 165

[56] References Cited

U.S. PATENT DOCUMENTS

| | | | |
|---|---|---|---|
| 2,231,479 | 2/1941 | Perry | 381/186 |
| 2,539,672 | 1/1951 | Olson et al. | 381/432 |
| 4,320,264 | 3/1982 | Visan et al. | 381/432 |

FOREIGN PATENT DOCUMENTS

| | | |
|---|---|---|
| 61-104698 | 7/1986 | Japan . |
| 375 598 | 6/1932 | United Kingdom . |
| 857 413 | 12/1960 | United Kingdom . |
| 2 079 564 | 1/1982 | United Kingdom . |
| 2 099 660 | 12/1982 | United Kingdom . |

*Primary Examiner*—Huyen Le
*Attorney, Agent, or Firm*—Ratner & Prestia

[57] ABSTRACT

A double cone-type loudspeaker which comprises a subcone made of highly heat-conductive material, attached to the front of the main cone and to a voice coil bobbin made of highly heat-conductive material. Heat generated in the coil portion of the voice coil travels directly to the bobbin portion and subcone, and is released to the front of the speaker. Consequently, a double cone-type loudspeaker with high maximum input power and high heat radiating capability is achieved.

10 Claims, 16 Drawing Sheets

DOUBLE CONE-TYPE LOUDSPEAKER

FIELD OF THE INVENTION

The present invention relates to the field of sound-reproducing systems and, more particularly, to speakers with superior maximum input power capability resulting from improved heat dissipation characteristics.

BACKGROUND OF THE INVENTION

Recently, more audio equipment is being designed for higher power, resulting in a growing demand for speakers with higher maximum input power. The coil portion of the voice coil generates heat as a result of electrical resistance when the input signal is applied to the speaker and current flows in the coil portion. This heat is radiated through the voice coil bobbin, magnetic gap and other components. However, if excessive input power is applied to the speaker and a high current flows through the coil portion, insufficient radiation takes place and the coil portion will bum out due to the generation of excessive heat.

Therefore, it is necessary to improve the heat radiating function to permit increased dissipation of the heat generated in the coil portion of the voice coil, to improve the maximum input power of the speaker.

One known arrangement for a speaker with a better heat radiating function is a speaker unit disclosed in Japanese Utility Model Laid-open Patent No. S61-104698. More specifically, a through-hole is provided along the shaft direction of the center pole, and a heat sink made of non-magnetic material is disposed inside the hole. This speaker unit is installed in a cabinet and used as a speaker system.

The heat transfer path of the above speaker unit is explained with reference to FIG. 16, which shows a section view of a speaker system employing the speaker unit disclosed in Japanese Utility Model Laid-open Patent No. S61-104698. When the input signal is applied to the speaker, heat is generated as a result of the electrical resistance of a coil portion 11 of the voice coil. This heat conducts through a magnetic gap 15 to a top plate 13 and the yoke 14 thereof. The heat then reaches a heat sink 12 disposed inside a yoke 14, and is released to the inside of cabinet 16. Heat conductivity, which indicates how fast heat can travel, is approximately 0.02W/m° K at the magnetic gap 15, 80 W/m° K at the top plate 13 and the yoke 14, and 240 W/m° K at the heat sink 12 (when it is made of aluminum).

Since the magnetic gap 15, which has low heat conductivity, is included in the heat transfer path, sufficient radiating effect cannot be expected due to the heat transfer loss.

In addition, heat released from the heat sink 12 will increase the temperature inside the cabinet 16. This results in a lower radiating effect due to the smaller temperature difference between the heat sink 12 and the inside of cabinet 16.

Furthermore, a die is needed for making the heat sink 12, resulting in higher cost.

Furthermore, since air passes through the narrow space created by the heat sink 12, an abnormal noise is generated by the moving air.

SUMMARY OF THE INVENTION

A double cone-type loudspeaker is provided with high maximum input power as a result of sufficient heat radiation.

A first exemplary embodiment of the present invention relates to a double cone-type loudspeaker comprising a subcone made of highly heat-conductive material. One part of the subcone is attached to the front of the main cone and another part is attached to the voice coil bobbin which is made of highly heat-conductive material. With this structure, heat generated in the coil portion of the voice coil travels directly through the voice coil bobbin and subcone, which have high heat conductivity, and is released through the front of the speaker.

Thus, a high radiating effect can be easily achieved. Consequently, the present invention provides a double cone-type loudspeaker with higher maximum input power.

A second exemplary embodiment of the present invention relates to a subcone with circumferential corrugations in addition to the structure of the first exemplary embodiment. The corrugations expand the surface area of the subcone. They also disperse the circumferential resonance of the subcone in a single frequency.

Thus, increased radiating effect can be achieved easily. Therefore, the present invention provides a double cone-type loudspeaker with high maximum input power. In addition, the present invention enables the flattening of frequency characteristics by dispersing frequencies which cause resonance, so as to suppress the peak frequency characteristics caused by resonance.

A third exemplary embodiment of the present invention, in addition to the structure of the first exemplary embodiment, relates to a subcone with a rib protruding toward the voice coil bobbin in an area bonded to the voice coil bobbin. The rib expands the area of the subcone contacting the voice coil bobbin, and also expands the bonding area of the subcone.

Thus, increased radiating effect can be achieved easily, and consequently, the third exemplary embodiment provides a speaker with high maximum input power. At the same time, a larger bonding area improves the bonding strength.

A fourth exemplary embodiment of the present invention, in addition to the structure of the first exemplary embodiment, relates to one or two holes, whose central angle is between 40° and 120°, which are disposed on the main cone within the area of the subcone.

In the case of two holes, they are disposed symmetrically about the center of the main cone. The outer periphery of the subcone is attached in an airtight fashion to the main cone. With this structure, heat in the subcone may also be released from the rear of the subcone. Furthermore, the hole(s) provided on the main cone convert high-frequency resonance above the second-harmonic to an axial asymmetry so as to suppress the peak frequency characteristics caused by resonance.

Thus, increased radiating effect can be achieved easily, and consequently, the fourth exemplary embodiment provides the speaker with higher maximum input power. At the same time, the fourth exemplary embodiment enables the flattening of the frequency characteristic by suppressing the peak frequency characteristics caused by the resonance of the main cone.

DESCRIPTION OF THE PREFERRED EMBODIMENTS

Exemplary embodiments of the present invention are explained below with reference to drawings.

First Exemplary Embodiment

Figure 1:
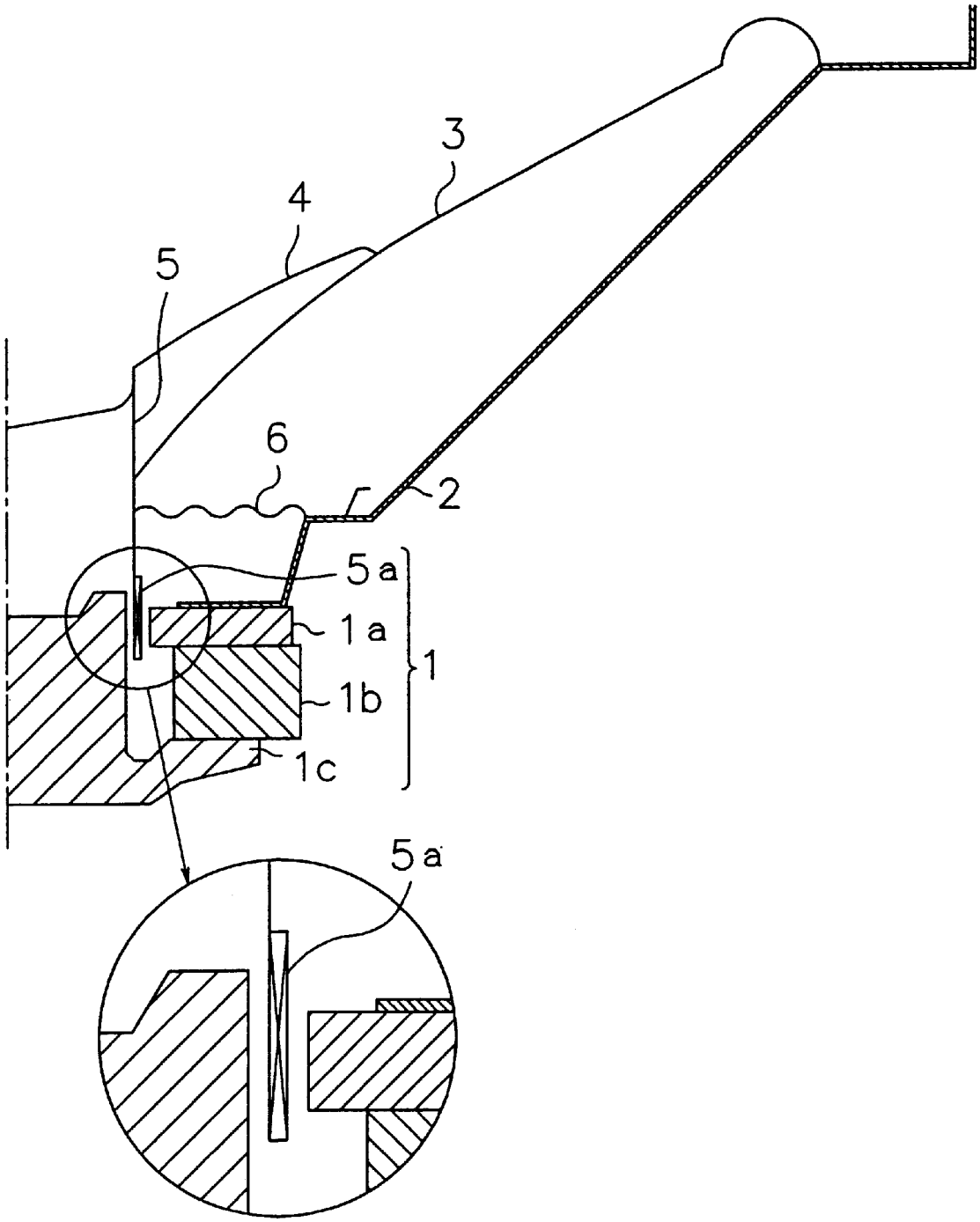
FIG. 1 is a half section view illustrating the structure of a double cone-type loudspeaker, in particular, around a voice coil portion in a first exemplary embodiment of the present invention.

FIG. 1 is a half section view of a Ø30 cm double cone-type loudspeaker in a first exemplary embodiment of the present invention. A field system 1 comprises a top plate 1*a*, magnet 1*b*, and yoke 1*c*. The top plate 1*a* is made of iron. Its outer diameter is ϕ85 mm, inner diameter is ϕ42 mm, and thickness is 8 mm. The magnet 1*b* is made of ferrite. Its outer diameter is ϕ90 mm, inner diameter is ϕ40 mm, and thickness is 15 mm. The outer diameter of the yoke 1*c* is ϕ80 mm. At the center of the yoke 1*c* is a pole, whose outer diameter is ϕ38.2 mm and height is 29 mm. An iron frame 2 is 0.8 mm thick and damper 6 is made of cotton cloth. As shown in FIG. 1 a voice coil has an inner diameter of ϕ38.66 mm, and comprises a 0.05 mm thick aluminum bobbin portion 5 and a voice coil portion 5*a* where ϕ0.22 mm copper wire is coiled. The voice coil portion 5*a* is secured in the magnetic gap of the field system 1 by the attachment of damper 6 to frame 2. The main cone 3 has an outer diameter of ϕ224 mm and is made of 0.5 mm thick paper which weighs 19 g. The main cone 3 has an urethane edge with a roll outer diameter of ϕ253 mm, roll inner diameter of ϕ225 mm, and thickness of 0.8 mm at its outer periphery. The inner periphery of the main cone 3 is attached to the bobbin portion 5. The main cone 3 is fixed to the frame 2 with its edge on the outer periphery.

A curved aluminum subcone 4 has a total weight of 3.5 g and is 0.11 mm thick. Its outermost diameter is ϕ120 mm, surface area is 160 $cm^2$, and radius of curvature is R100 mm. The outermost periphery of the subcone 4 is fixed to the front of the main cone 3 with rubber adhesive. The inner periphery of subcone 4 is tapered for 5 mm height with a taper angle of 5.5°. This tapered portion is fitted to the inner periphery of the bobbin portion 5, and secured with rubber adhesive. The inside of subcone 4 is concaved to R55 mm with the center of the curve on the top.

Operation of the double cone-type loudspeaker configured as above is explained below.

When a signal is input to the speaker, the temperature of the voice coil portion 5*a* increases. The heat generated in voice coil portion 5*a* travels to the aluminum bobbin portion 5 which has heat conductivity of 240 W/m° K (about 12,000 times that of air), then to the aluminum subcone 4 attached to the voice coil bobbin, and released to the front of the speaker.

Figure 2:
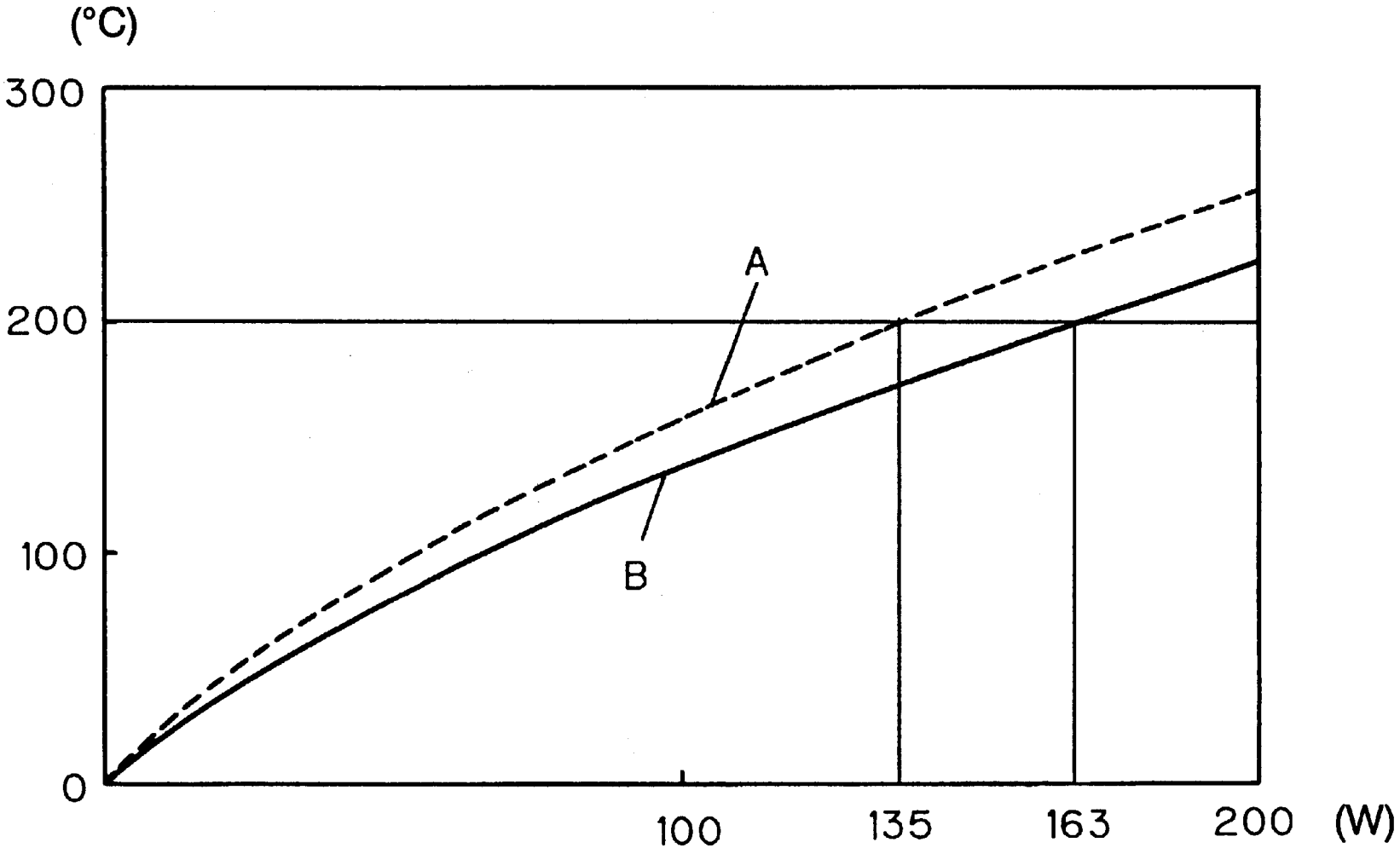
FIG. 2 is a graph showing the relation of the input power and temperature increase for the voice coil portion of the double cone-type loudspeaker of the first exemplary embodiment and the prior art.

Next, measured radiation characteristics of the prior art and the double cone-type loudspeaker in the first exemplary embodiment are compared. FIG. 2 shows actual measurement results of the temperature increase which illustrate the relation of the input power to the speaker installed in a 100 liter capacity cabinet and the temperature increase of the coil portion of the voice coil. The input power plotted along the abscissa indicates the power of the noise signal specified as DIN standard 45573 Tei 112 (1979). The temperature increase plotted along the ordinate indicates the increase in temperature of the voice coil portion 5*a* when the noise power shown on the abscissa is applied. In general, the voice coil portion 5*a* will burn out and destroy the speaker if the temperature increase exceeds 200° C. even if highly heat-resistant material is used for the voice coil. Line A shows the results of the prior art which employs a field system and voice coil identical to that of the first exemplary embodiment but comprises a heat sink at the center of the yoke. Line B shows the results of the first exemplary embodiment. Comparing the power at which the temperature reaches 200° C. in the prior art and the present invention, power applied to the prior art is 135 W and that of the first exemplary embodiment is 163 W. The results show that the power handling capacity improves by approximately 21%. In other words, the exemplary embodiment increases the maximum input power of the speaker by 21%.

As explained above, the first exemplary embodiment of the present invention can i) reduce loss in heat transfer, ii) release heat to the cooler environment outside the cabinet, and iii) improve the radiating effect of the speaker by ensuring that heat generated in the voice coil portion 5*a* travels through only highly-conductive areas and releases the heat through the front of the speaker. Accordingly, the present invention offers a speaker with higher maximum input power.

In the first exemplary embodiment, aluminum with heat conductivity of 240 W/m° K is used for the bobbin portion 5 and subcone 4. The equivalent effect is obtainable with titanium, copper or brass. Naturally, the same effect can be expected with the use of materials with about 80 W/m° K heat conductivity.

Second Exemplary Embodiment

Figure 3:
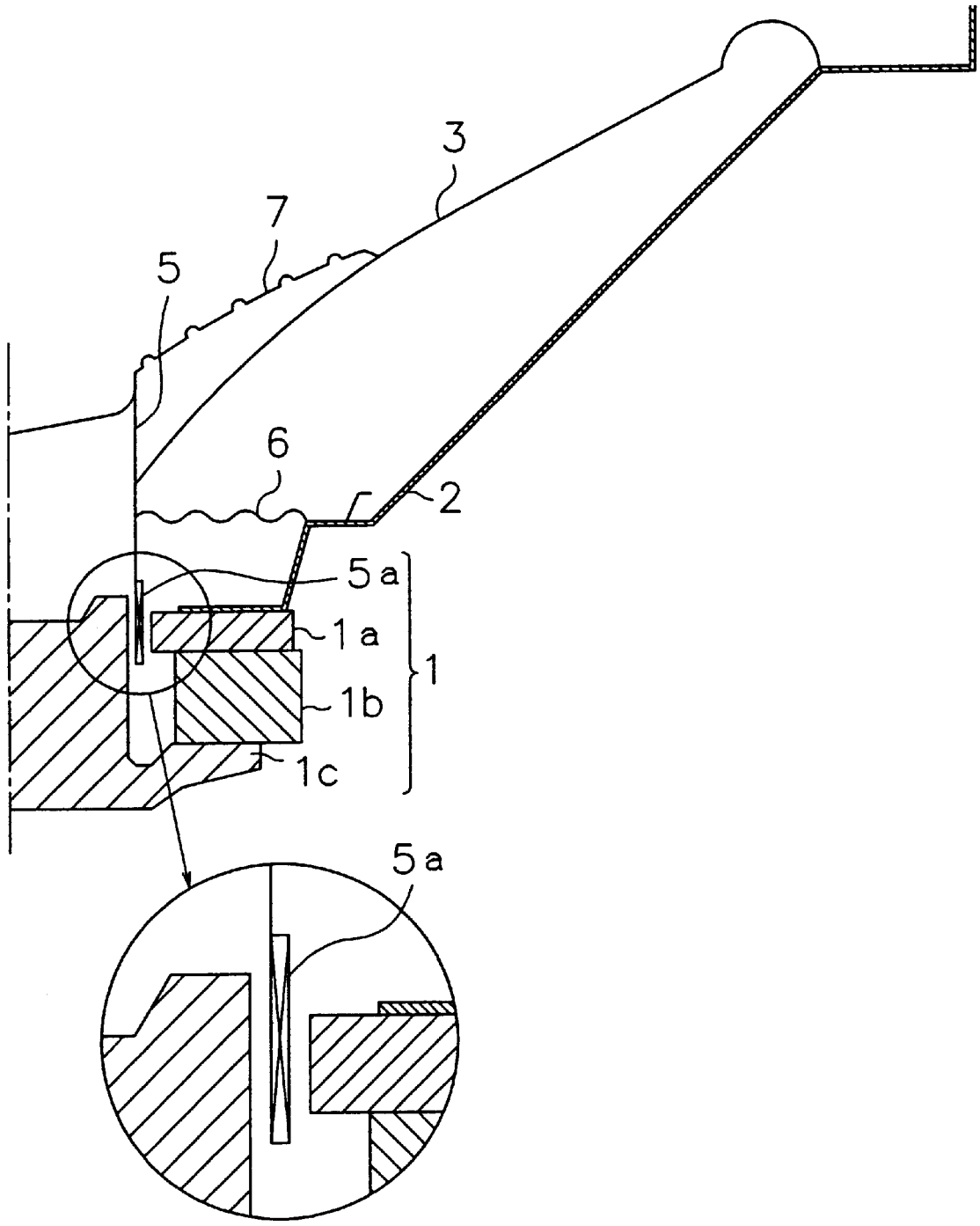
FIG. 3 is a half section view illustrating the structure of a double cone-type loudspeaker, in particular, around a voice coil portion in a second exemplary embodiment of the present invention.
Figure 4:
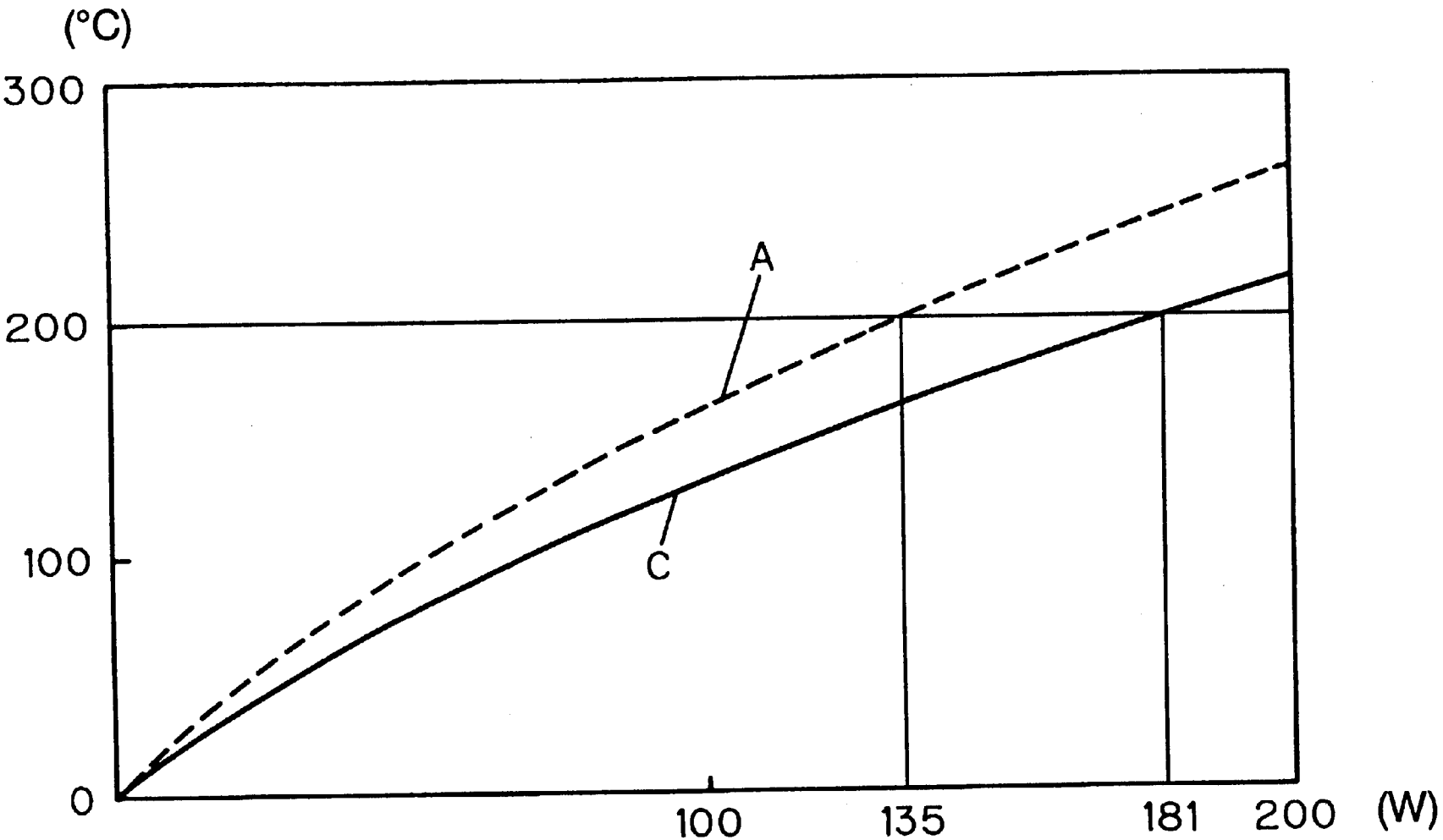
FIG. 4 is a graph showing the relation of the input power and temperature increase for the voice coil of the double cone-type loudspeaker of the second exemplary embodiment and the prior art.

FIG. 3 is a section view of a double cone-type loudspeaker in a second exemplary embodiment of the present invention. The only difference between the second exemplary embodiment and the first exemplary embodiment is the shape of the subcone. An aluminum subcone 7 has an outer diameter of ϕ120 mm and thickness of 0.11 mm. At the position of ϕ45 mm, ϕ60 mm, ϕ75 mm, ϕ90 mm, and ϕ105 mm on its oscillation portion, R1 mm corrugations protruding toward the front of the speaker are disposed in the circumferential direction. These corrugations enlarge the surface area of subcone 7 by about 15% compared to a subcone without corrugations. FIG. 4 shows the temperature increase curve of voice coil portion 5*a*. As in the first exemplary embodiment, the power at which the temperature reaches 200° C. is compared between the prior art and the second exemplary embodiment. Power applied to the prior art is 135 W while the power applied to the second exemplary embodiment is 181 W. The results show that the power handling capability improves by approximately 34%. Thus, the exemplary embodiment increases the maximum input power of the speaker by 34%.

Figure 5:
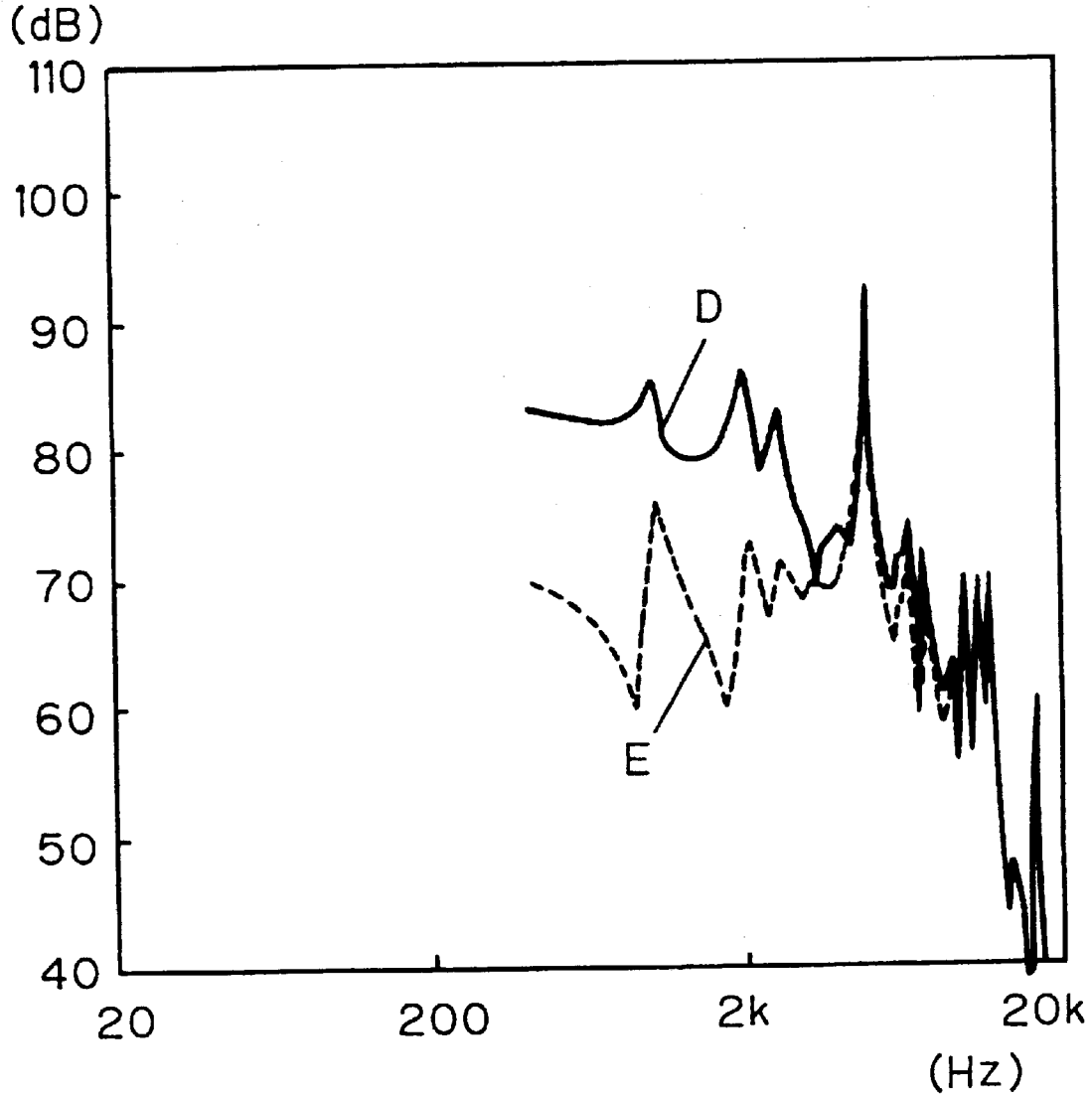
FIG. 5 is a graph illustrating the results of FEM (finite element model) simulation of sound pressure frequency characteristics for the speaker of the first exemplary embodiment of the present invention.
Figure 6:
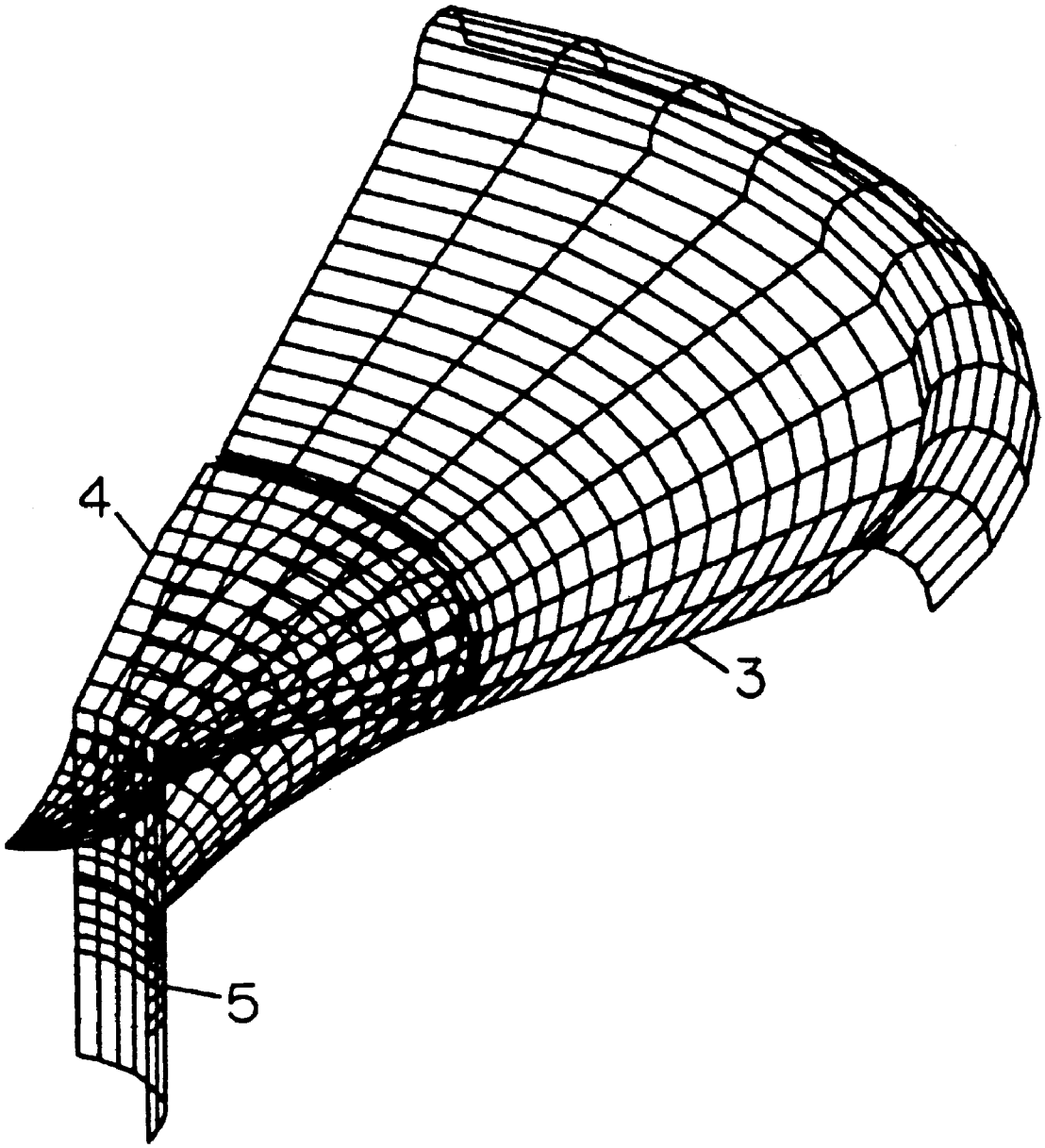
FIG. 6 is an original simulation model for the speaker of the first exemplary embodiment.
Figure 7:
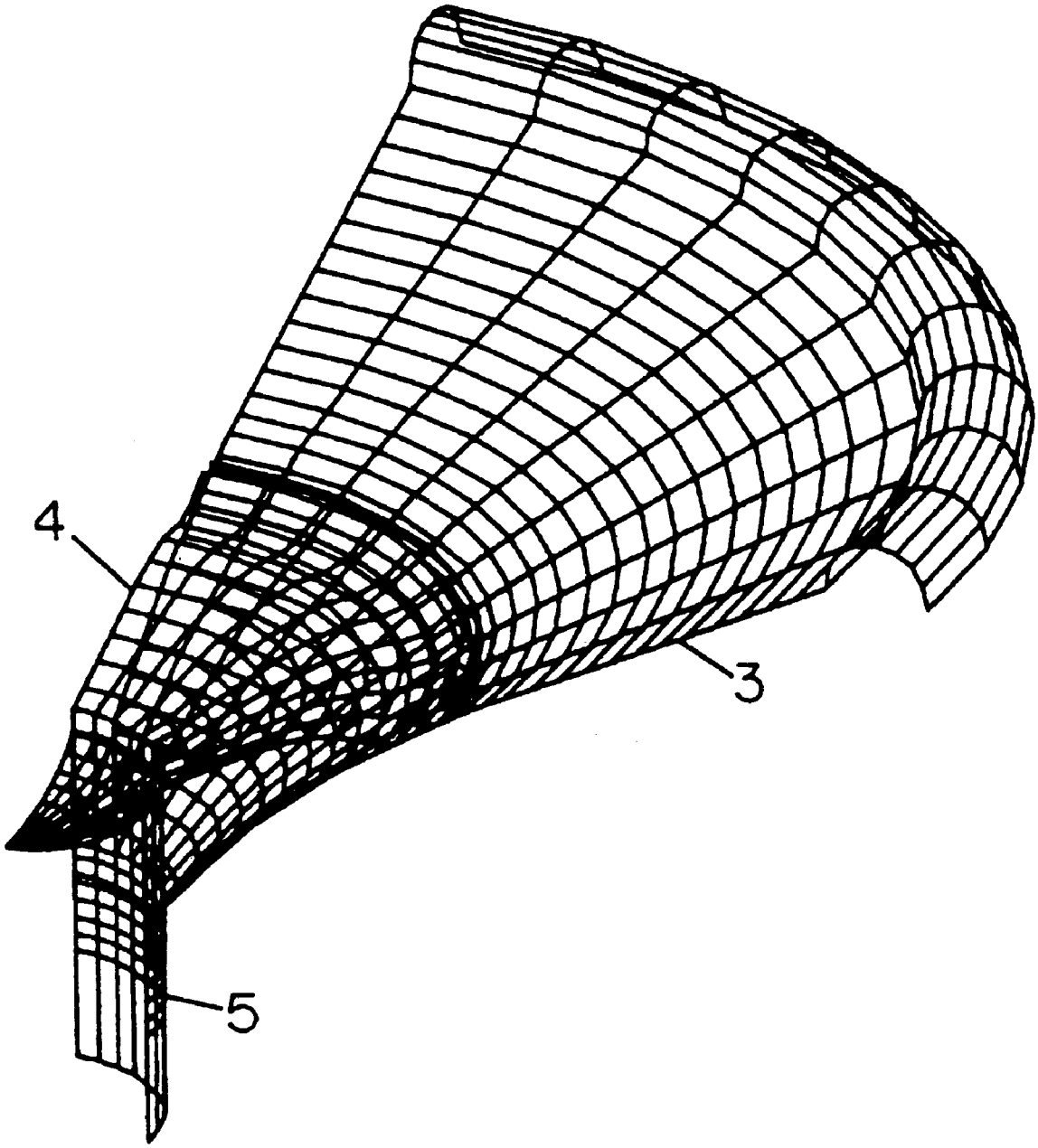
FIG. 7 is a distorted simulation model for the speaker of the first exemplary embodiment.

FIG. 5 shows simulation results of the sound pressure frequency characteristics of the first exemplary embodiment using finite element analysis. Line D shows the total frequency characteristics of the main cone including the edge and subcone. Line E is the frequency characteristics of only the subcone. As shown in the graph, a large peak is noticeable around 4.8 kHz. FIG. 6 is an original simulation model for one fourth of the oscillation system of the speaker. FIG. 7 shows a model distorted around 4.8 Hz. A large distortion is noticeable near the outer periphery of the subcone in the circumferential direction.

Figure 8:
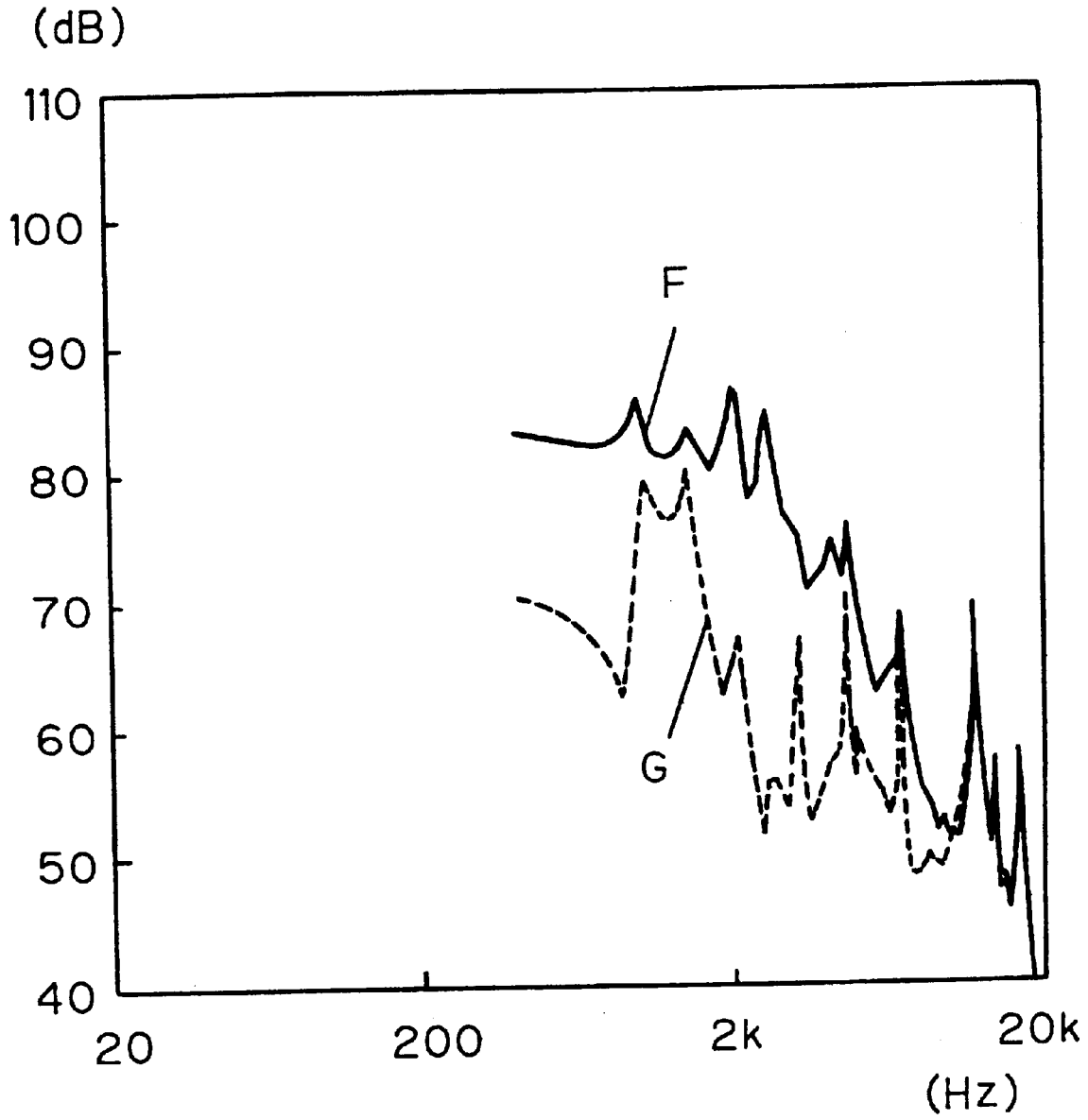
FIG. 8 is a graph illustrating the results of FEM simulation of sound pressure frequency characteristics for the speaker of the second exemplary embodiment of the present invention.
Figure 9:
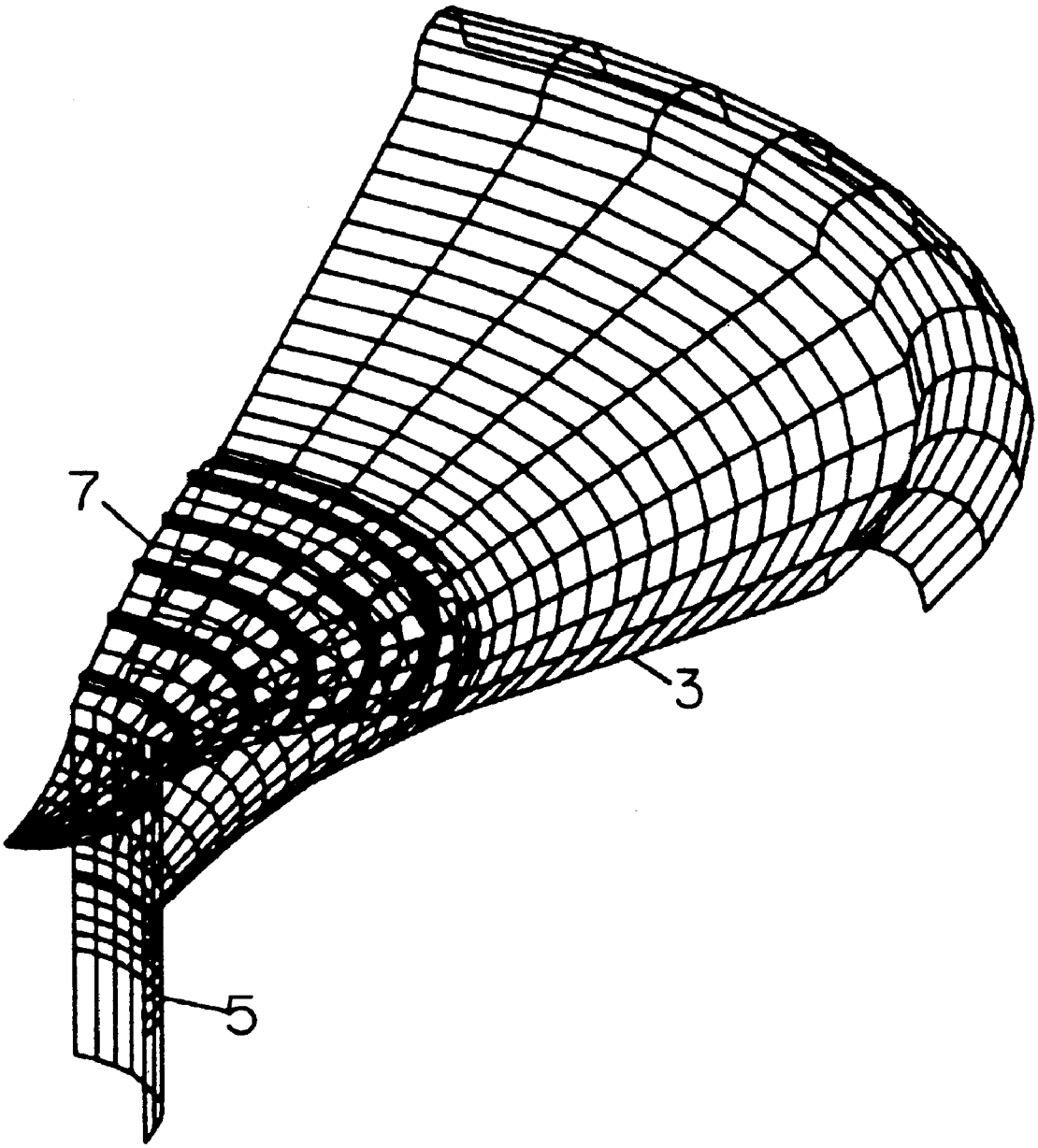
FIG. 9 is an original simulation model for the speaker of the second exemplary embodiment.

Therefore, it is apparent that the peak in frequency characteristics around 4.8 kHz is caused by distortion due to resonance of the subcone. FIG. 8 shows simulation results of sound pressure frequency characteristics of the second exemplary embodiment. FIG. 9 is an original simulation model. Line F in FIG. 8 shows the total frequency characteristics of the speaker, and Line G shows the frequency characteristics of only the subcone. The simulation results indicate that circumferential distortion of the subcone due to resonance is dispersed by the provision of corrugations. The occurrence of a large in frequency characteristic peak caused by concentration of resonance at a single frequency is greatly suppressed Thus, the second exemplary embodiment improves the radiating effect by using a larger surface area for radiating heat and the provision of corrugations on the subcone. Moreover, the resonance frequency of the subcone is changed at each corrugation which enables the disbursement of peak characteristics caused by resonance distortion. Consequently, the second exemplary embodiment offers a speaker with higher maximum input power capability and flatter high-frequency characteristics.

Figure 10A:
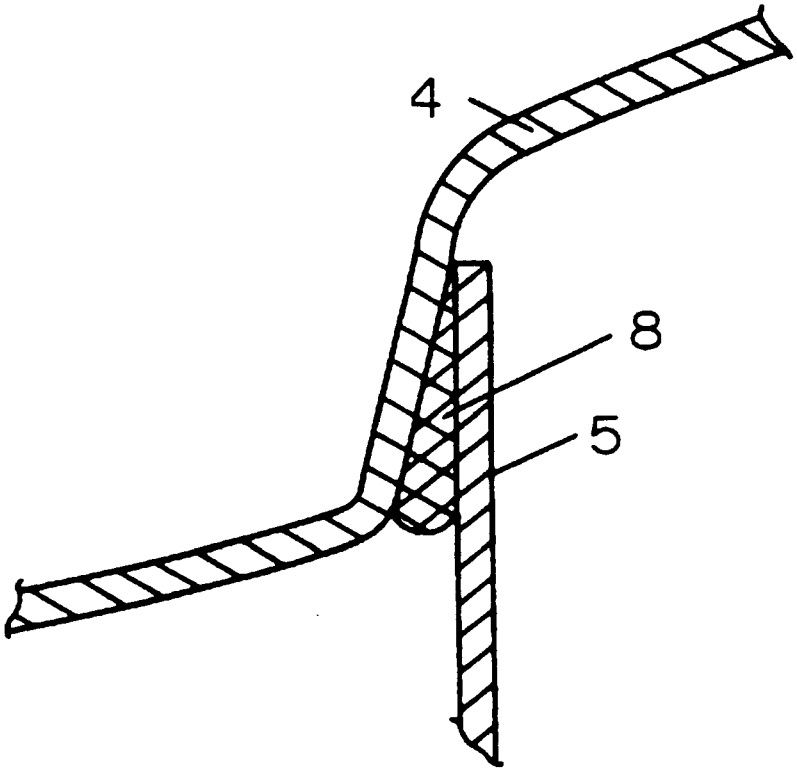
FIG. 10A is an enlarged half section view of a bonding portion of the subcone and voice coil bobbin for the speaker of the first exemplary embodiment.

FIG. 10A is an enlarged section view of a bonding portion of the subcone 4 and the bobbin portion 5 of the first exemplary embodiment. The bonding portion of the subcone is tapered for improving formability of the subcone 4 and workability at inserting the bonding portion to the bobbin portion 5. This provides linear contact between subcone 4 and bobbin portion 5 by filling a space created by the taper with a rubber adhesive 8.

Third Exemplary Embodiment

Figure 10B:
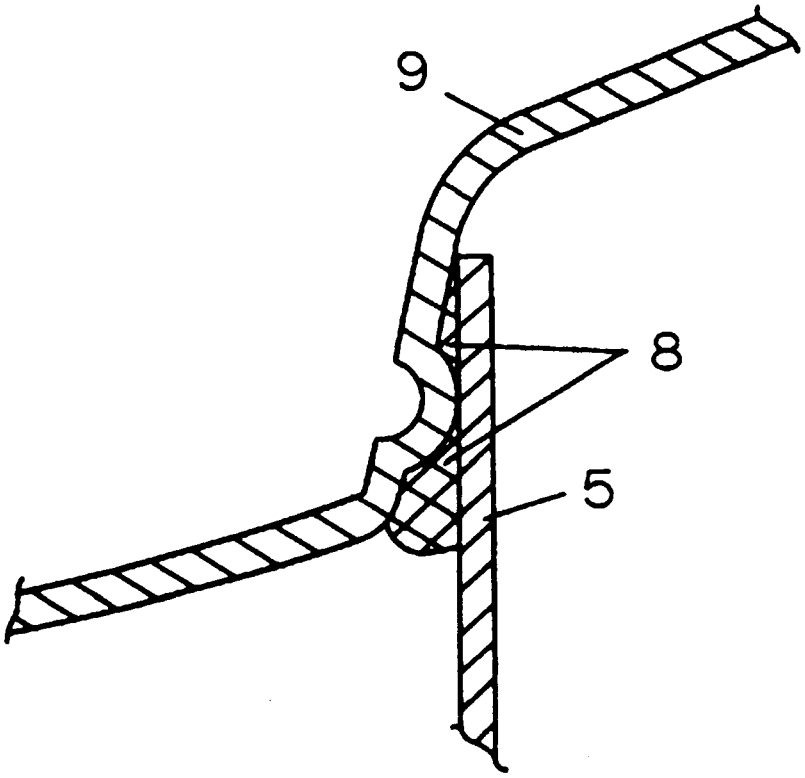
FIG. 10B is an enlarged half section view of a bonding portion of the subcone and voice coil bobbin for the speaker of the third exemplary embodiment of the present invention.

FIG. 10B is an enlarged section view of a bonding portion between the subcone and voice coil of the double cone-type loudspeaker of the third exemplary embodiment.

A R1 mm rib, whose outer diameter is ϕ38.66 mm, protruding toward and contacting the bobbin portion 5 is provided on the taper of the bonding portion of a subcone 9 in the circumferential direction. The remainiing structure is the same as in the first exemplary embodiment. The structure of the third exemplary embodiment is enlarges the contact surface because subcone 9 and bobbin portion 5 contact each other at two points: a tip of the bobbin portion 5 and the rib.

In the first exemplary embodiment, the subcone 4 and the tip of the bobbin portion 5 may come apart and the high-heat conductive portions may not remain in direct contact if the position of subcone 4 deviates upward or bobbin portion 5 deviates downward. In the third exemplary embodiment, however, the rib always remains in contact with the bobbin even if the tip of the bobbin portion 5 detaches from the subcone. In addition, the adhesion area will be enlarged because the surface area of the bonding portion of the subcone 9 becomes larger by provision of the rib.

Figure 11:
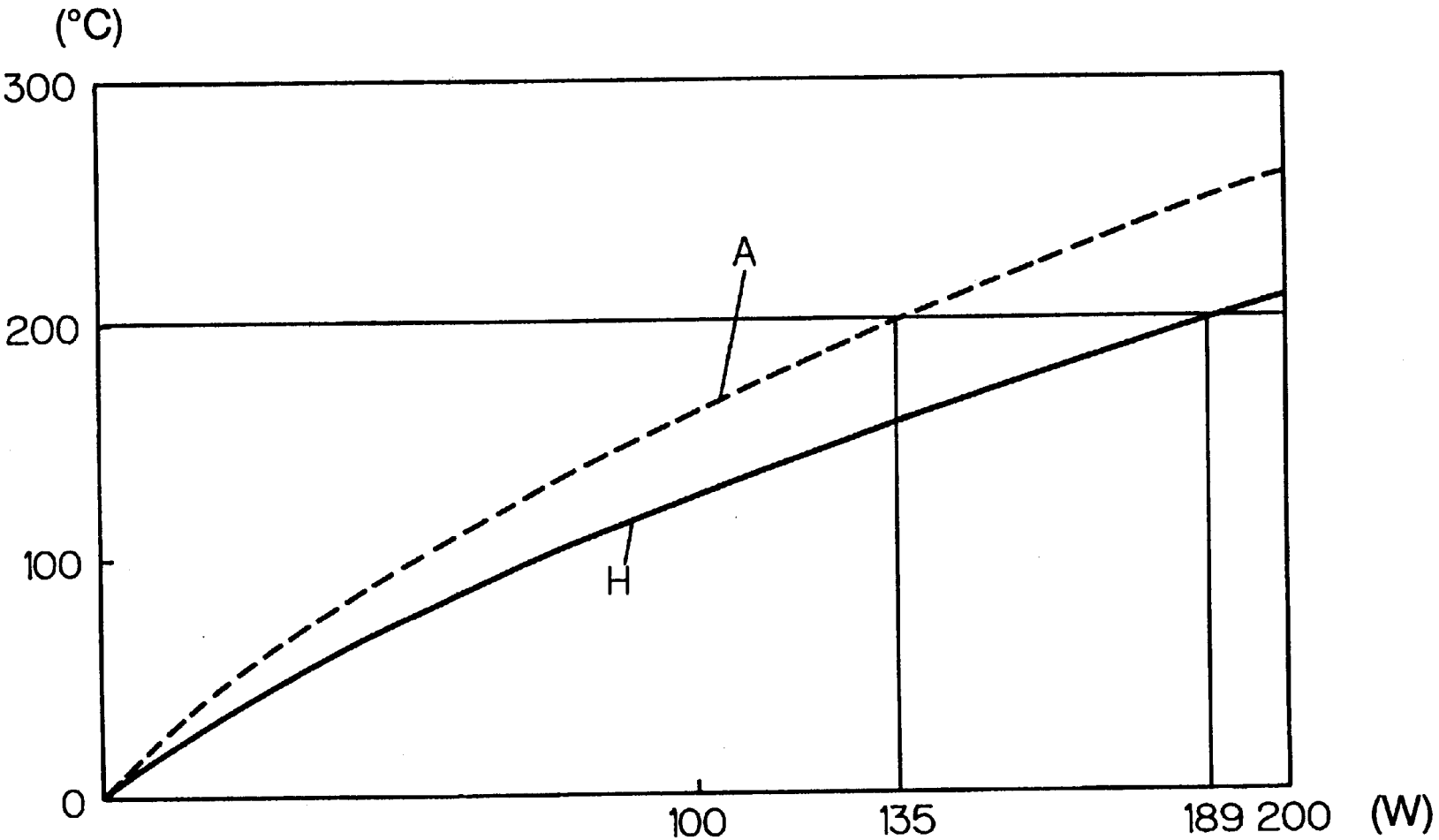
FIG. 11 is a graph showing the relation of the input power and temperature increase of the voice coil of the double cone-type loudspeaker of the third exemplary embodiment and the prior art.

FIG. 11 shows the temperature increase curve of the voice coil portion 5*a*. As in the first exemplary embodiment, power applied at which the temperature reaches 200° C. is compared between the prior art and the third exemplary embodiment. The prior art employs the field system and voice coil identical to that of the third exemplary embodiment but comprises a heat sink at the center of the yoke. Power applied to the prior art is 135 W and that to the third exemplary embodiment is 189 W. This shows that the power handling capability improves by approximately 40%. Thus, the exemplary embodiment increases the maximum input power capability of the speaker by 40%.

The third exemplary embodiment improves the radiating effect by expanding the contact area of the bonding portion between the subcone and bobbin portion 5. It also improves the adhesion strength of the bonding portion by providing a larger surface area for the bonding portion of the subcone. Consequently, the present invention offers a speaker with higher maximum input power and increased structural stability.

FOURTH EXEMPLARY EMBODIMENT

Figure 12:
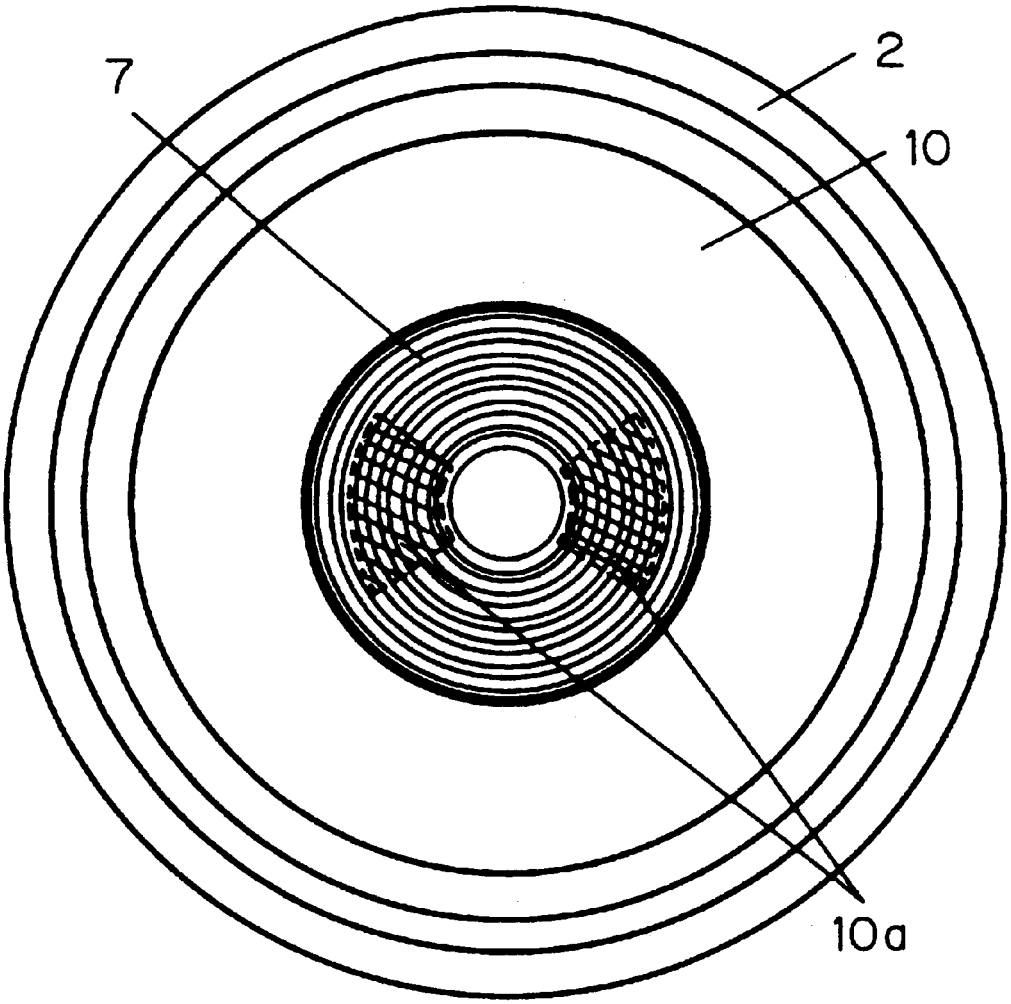
FIG. 12 is a front view of a double cone-type loudspeaker in the fourth exemplary embodiment of the present invention.

FIG. 12 is a front view of a double cone-type loudspeaker in a fourth exemplary embodiment of the present invention. The speaker has the same structure as the second exemplary embodiment except for main cone 10. A hole 10*a* whose inner diameter is ϕ46 mm, outer diameter is ϕ100 mm, and central angle is 72° is disposed on main cone 10. A second hole is disposed symmetrically with respect to the center of the main cone 10. The outer periphery of the subcone 7 is attached in an airtight fashion to main cone 10. With this structure, the rear side of the subcone 7 also contacts the air inside the cabinet, and helps improve the radiating effect of the speaker.

Figure 13:
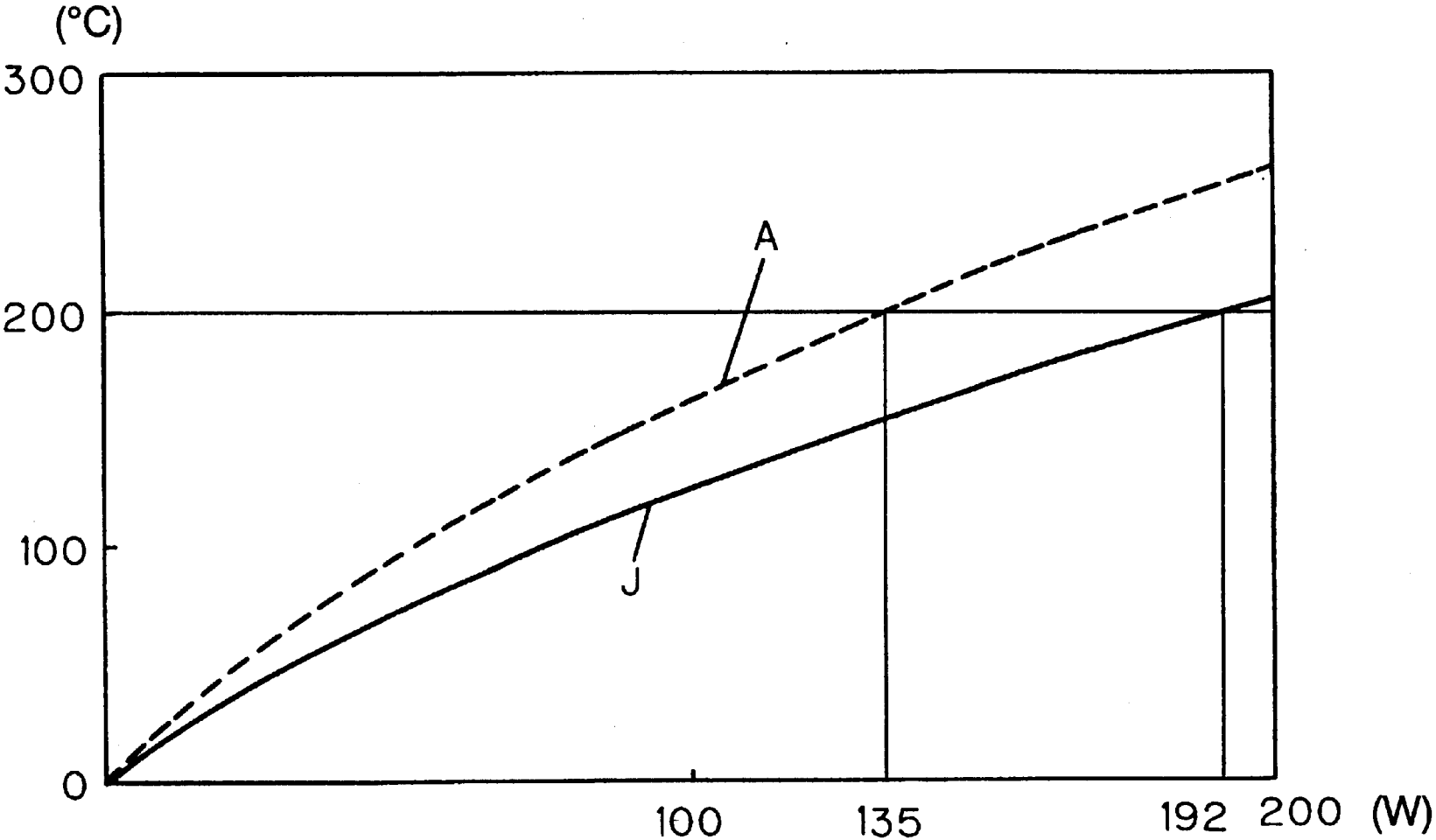
FIG. 13 is a graph showing the relation of the input power and temperature increase of the voice coil for the double cone-type loudspeaker of the fourth exemplary embodiment and the prior art.

FIG. 13 shows the temperature increase curve of the voice coil portion 5*a*. As in the first exemplary embodiment, the power at which the temperature reaches 200° C. is compared between the prior art and the fourth exemplary embodiment.

The prior art employs the same field system and voice coil as the exemplary embodiment but comprises a heat sink at the center of the yoke. Power applied to the prior art is 135 W and the power applied to the fourth exemplary embodiment is 192 W. The results show that the power handling capability improves by approximately 42%. Thus, the exemplary embodiment increases the maximum input power of the speaker by 42%.

Figure 14:
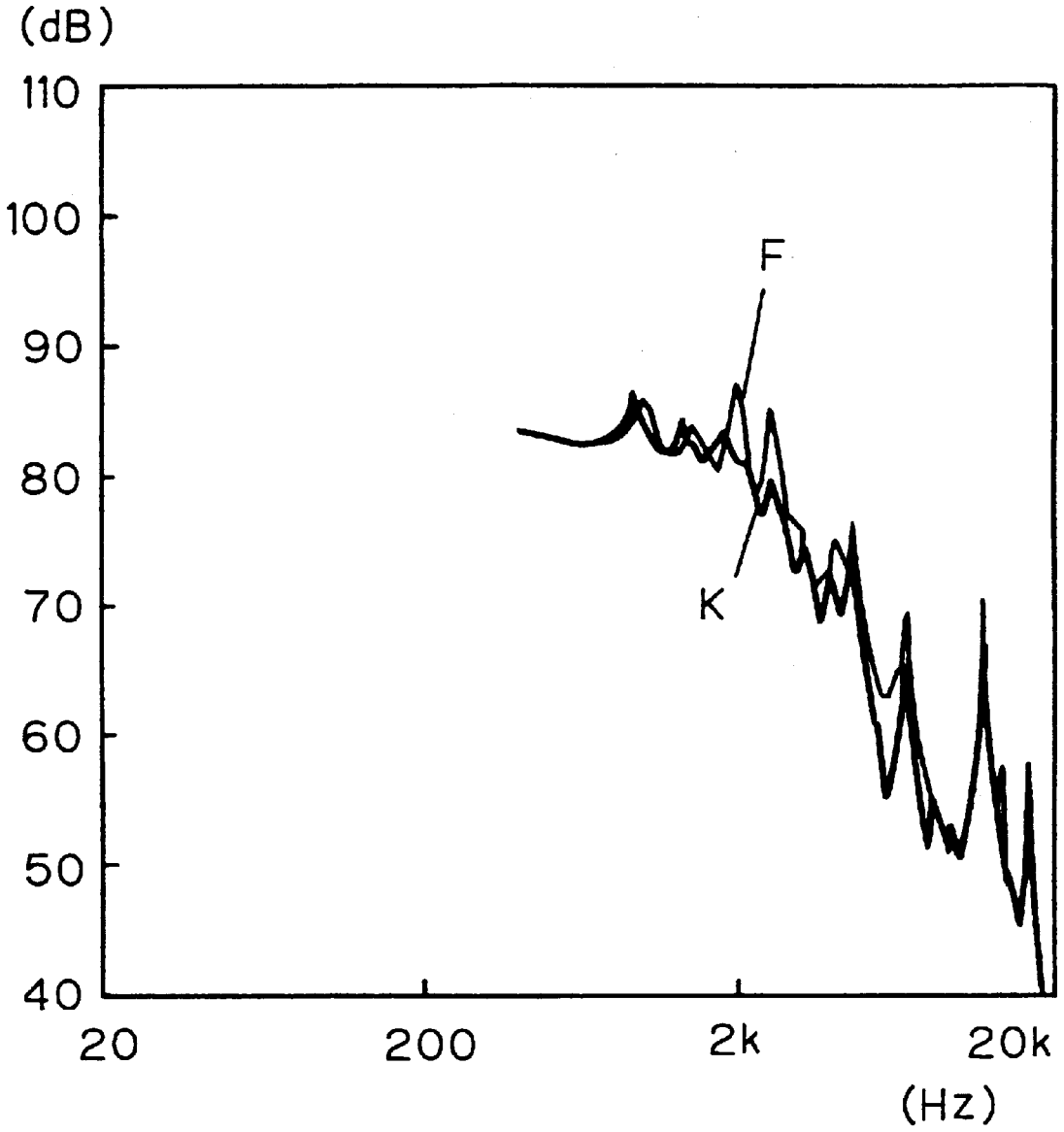
FIG. 14 is a comparison of simulation results of sound pressure frequency characteristics for the speaker in the second and fourth exemplary embodiments.
Figure 15:
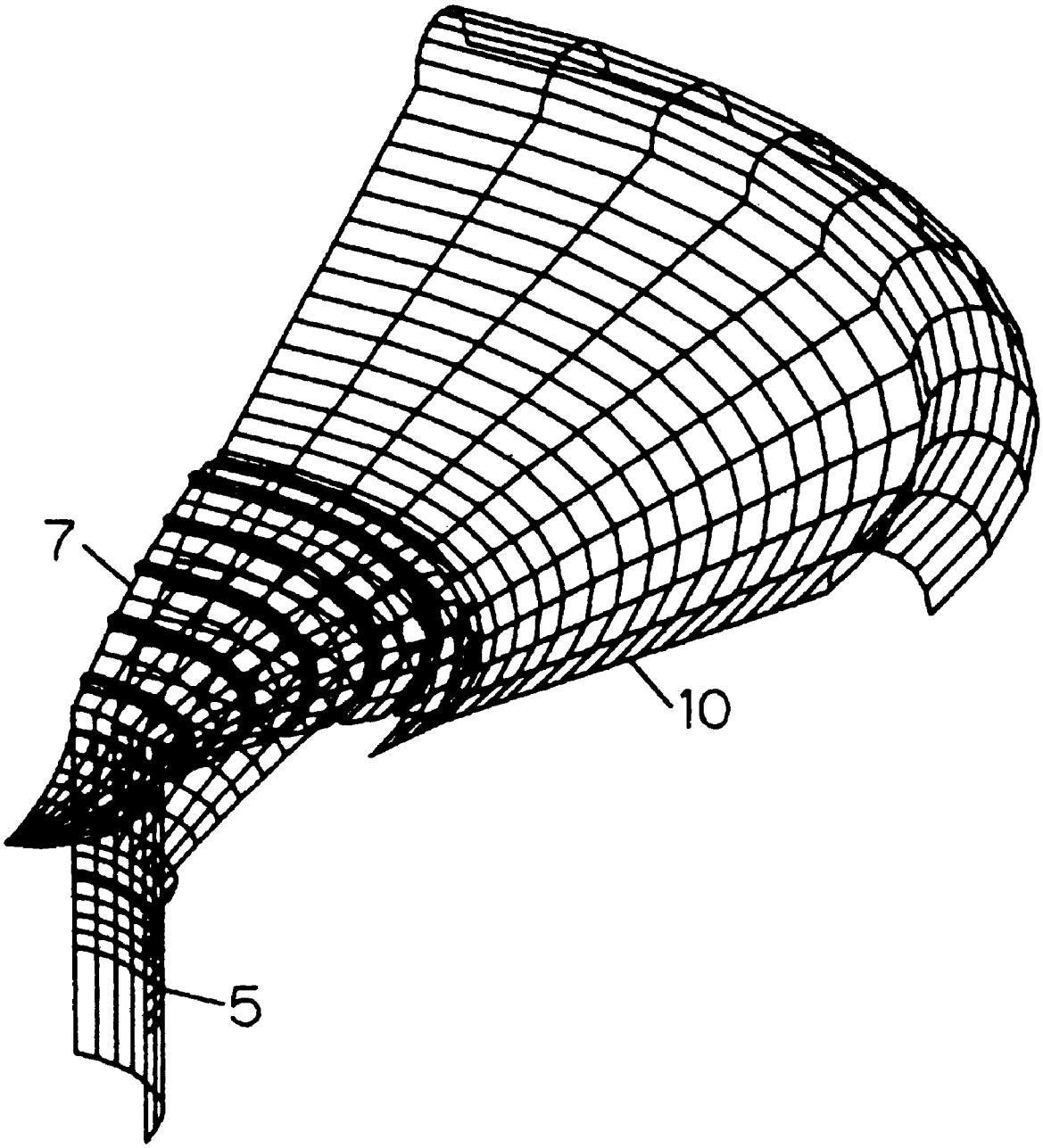
FIG. 15 is an original simulation model for the speaker of the fourth exemplary embodiment of the present invention.
Figure 16:
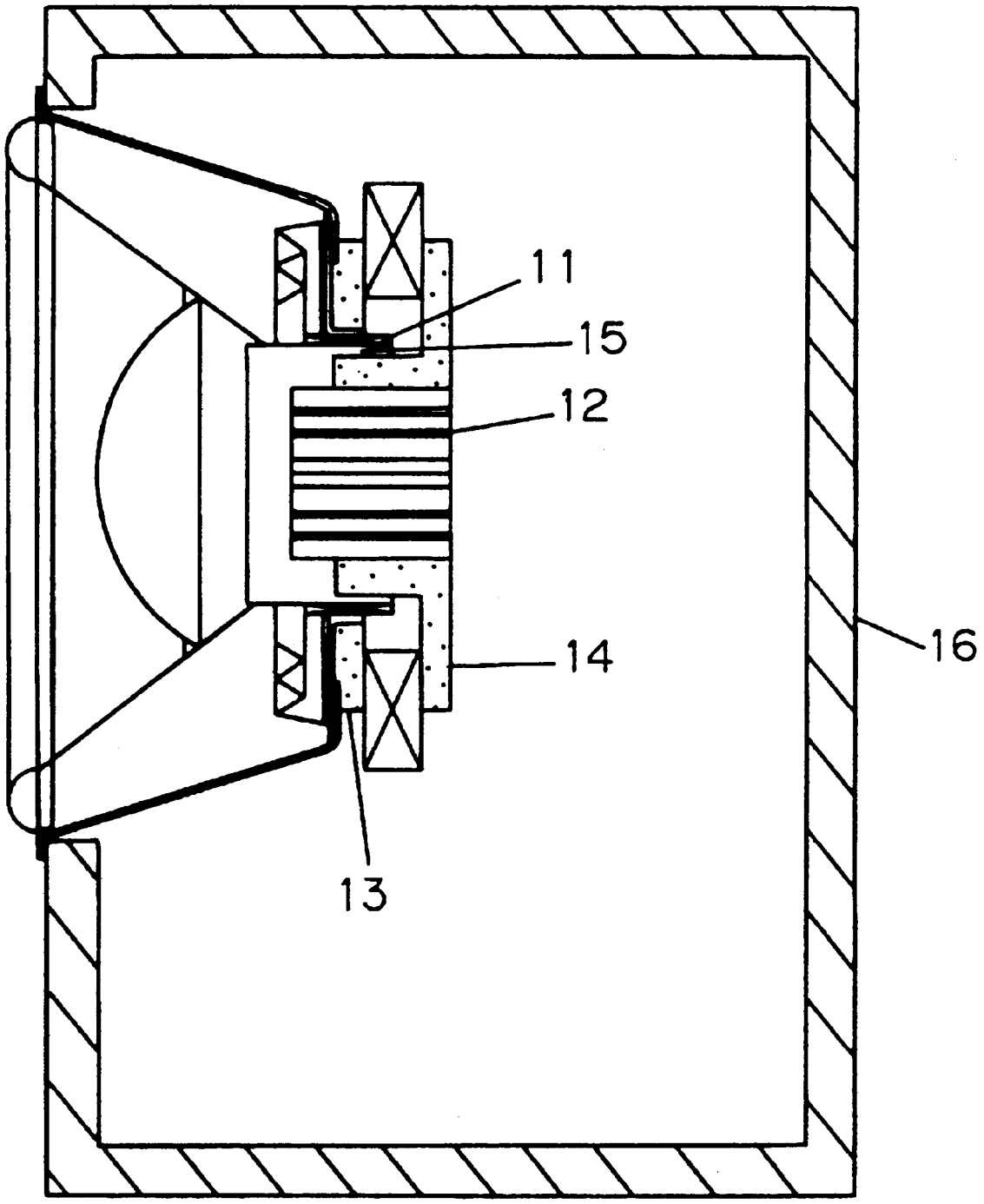
FIG. 16 (PRIOR ART)
FIG. 16 is a section view of a double cone-type loudspeaker of the prior art.

FIG. 14 shows simulation results of the sound pressure frequency characteristics for the speaker of the second and fourth exemplary embodiments using finite element analysis. Line F shows the characteristics of the second exemplary embodiment and Line K shows the characteristics of the fourth exemplary embodiment. FIG. 15 is an original simulation model. Looking at FIG. 14, it is apparent that the fourth exemplary embodiment reduces the 2 kHz peak by about 4 db and the 2.5 kHz peak by about 5 dB over the second exemplary embodiment. This is due to the hole disposed on main cone 10. The hole converts high-frequency resonance above the second-harmonic to an axial asymmetry and suppresses the peak frequency characteristics caused by resonance.

The hole also functions as a mechanical high frequency filter which attenuates sound emission in the high frequency band from the main cone, thereby suppressing interference with sound from the subcone.

Thus, the fourth exemplary embodiment enables further improvement of the radiating effect by using the rear side of the subcone for radiation. Moreover, the hole on the main cone functions as a mechanical high frequency filter to reduce the peak caused by resonance of the main cone. Accordingly, the present invention provides a speaker with higher maximum input power and flatter high-frequency characteristics.

In the exemplary embodiment, the hole disposed on the main cone 10 has a central angle of 72°. It should be noted that, through computer simulation and actual measurement, the same effect is confirmed when the central angle is between 40° and 120°.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A double cone-type loudspeaker comprising:

a voice coil having a bobbin made of a metal;

a main cone having a front and having a first heat conductivity; and a subcone having a first portion attached to the front of the main cone and a second portion attached to the bobbin, said subcone having a second heat conductivity greater than said first heat conductivity.

2. A double cone-type loudspeaker as defined in claim 1, wherein said subcone is provided with at least one corrugation situated at least substantially all they way around said subcone and located away from an edge of said subcone.

3. A double cone-type loudspeaker as defined in claim 2, wherein said subcone has a rib, said rib protruding toward the voice coil bobbin, and said rib is disposed on a portion of said subcone bonded to the voice coil bobbin.

4. A double cone-type loudspeaker as defined in claim 3, wherein the main cone has no more than two holes at a symmetric position from a center of the main cone, said holes having a central angle between 40° and 120°, and said holes disposed within an area of the subcone; and said subcone is attached to said main cone.

5. A double cone-type loudspeaker as defined in claim 2, wherein the main cone has no more than two holes at a symmetric position from a center of the main cone, said holes having a central angle between 40° and 120°, and said holes are disposed within an area of the subcone; and said subcone is attached to said main cone.

6. A double cone-type loudspeaker as defined in claim 1, wherein said subcone has a rib, said rib protruding toward the voice coil bobbin, and said rib is disposed on a portion of said subcone bonded to the voice coil bobbin.

7. A double cone-type loudspeaker as defined in claim 3, wherein the main cone has no more than two holes at a symmetric position from a center of the main cone, said holes having a central angle between 40° and 120°, and said holes are disposed within an area of the subcone; and said subcone is attached to said main cone.

8. A double cone-type loudspeaker as defined in claim 1, wherein the main cone has no more than two holes at a symmetric position from a center of the main cone, said holes having a central angle between 40° and 120°, and said holes are disposed within an area of the subcone; and said subcone is attached to said main cone.

9. A double cone-type loudspeaker comprising:

a main cone having a front and having a first heat conductivity;

a voice coil having a bobbin made of a metal; and a subcone attached to the front of the main cone and the voice coil bobbin, said subcone having a second heat conductivity greater than said first heat conductivity.

10. A loudspeaker comprising:

a first cone having a first surface and having a first heat conductivity, a voice coil bobbin, said voice coil bobbin made of a metal, and a second cone having a first portion and a second portion, said first portion coupled to the first surface of said first cone and said second portion coupled to said voice coil bobbin, said subcone having a second heat conductivity greater than said first heat conductivity.

* * * * *

UNITED STATES PATENT AND TRADE MARK OFFICE

CERTIFICATE OF CORRECTION

PATENT NO. : 5,933,512
DATED : August 3, 1999
INVENTOR(S) : Tamura

It is certified that error appears in the above-identified patent and that said Letters Patent is hereby corrected as shown below:

Column 8, line 25, delete "3" and insert --6--.

Signed and Sealed this

Ninth Day of May, 2000

*Attest:*

Q. TODD DICKINSON

*Attesting Officer*

*Director of Patents and Trademarks*